United States Patent [19]

Krebser

[11] 4,289,065

[45] Sep. 15, 1981

[54] SPACERS FOR CAGE PRESSES

[75] Inventor: John P. Krebser, Piqua, Ohio

[73] Assignee: The French Oil Mill Machinery Company, Piqua, Ohio

[21] Appl. No.: 132,707

[22] Filed: Mar. 21, 1980

[51] Int. Cl.[3] ..... B30B 9/06

[52] U.S. Cl. ..... 100/129; 100/145

[58] Field of Search ..... 100/117, 126, 127, 129, 100/145, 147, 148, 149, 150

[56] References Cited

U.S. PATENT DOCUMENTS

| | | | |
|---|---|---|---|
| 3,115,087 | 12/1963 | Ginaven | 100/129 |
| 3,126,820 | 3/1964 | Upton | 100/129 |
| 3,373,680 | 3/1968 | Burnham | 100/129 |

*Primary Examiner*—Peter Feldman

*Attorney, Agent, or Firm*—Biebel, French & Nauman

[57] ABSTRACT

Spacers for cage presses having a cylindrical cage formed of axially extending radially spaced screen bars, each spacer having an L-shaped configuration formed of a single piece of sheet material having approximately the thickness of the desired width of opening between innermost edge portions of adjacent screen bars, and secured at uniform spacings along the length of an adjacent screen bar with the leg portion extending inwardly of the cage and terminating adjacent the innermost edge portions of adjacent screen bars and in contact therewith to establish the minimum separation between adjacent screen bars, and having the foot portion extending substantially tangentially and in contact with the adjacent screen bars near the outer edge portions of the screen bars, each spacer being welded to the adjacent screen bar on the leg portion of the spacer.

4 Claims, 5 Drawing Figures

SPACERS FOR CAGE PRESSES

BACKGROUND OF THE INVENTION

1. Field of the Invention

The present invention relates to cage presses, and more particularly, to spacer elements for use in separating the screen bars of a cylindrical cage press.

2. Prior Art

Cage presses of the type to which the present invention relates are generally constructed of a plurality of rectangular cross section screen bars which are arranged to form a cylindrical cage with the screen bars extending axially along the cage and separated at their innermost edge portions a specific distance which permits oils or other liquids to be expressed from materials being fed through the press. An axially extending screw or worm rotates in the cylindrical cage and compresses the material containing the liquid so that the liquid is forced out between the screen bars.

The spacers are therefore critical in the operation of the press, in that they must maintain the proper gap between the innermost edge portions of adjacent screen bars in order to permit only the oil or other liquid being expressed from the material to pass through these spaces between the screen bars with minimal passage of particles of the material itself. Since the screen bars are of rectangular cross section, the gap from the innermost edge portion to the outermost edge portions of adjacent screen bars is continuously widening and therefore requires essentially a wedge shaped configuration of spacer to produce the necessary gap at the innermost edge portions as well as providing support between the screen bars at their outermost edge portions since the screen bars and spacers take substantial compression loading during operation of the press.

Two examples of prior art spacers for use in cage presses are disclosed, for example, in U.S. Pat. Nos. 3,126,820 and 3,373,680, assigned to the assignee of the present invention. These devices are both generally wedge shaped and since they are made of steel they must be formed, either by a machining or forging operation, to the exact tolerances necessary to provide the desired spacing and support between adjacent screen bars. In addition, in the past means have been utilized for locating and holding the spacers at the proper locations on the screen bars, such as using a projecting stub or tab on each spacer which mates with a corresponding hole formed in the adjacent screen bar.

The cost of producing such spacers has increased substantially due to both material cost and labor cost increases which make them extremely expensive to produce, and in addition, require that substantial numbers be produced at one time in order to make their production more cost effective. Unfortunately, this usually means that the number of spacers that must be produced at one time may be well beyond the number which will be utilized in immediate production demands and replacements, and therefore requires excessive inventory of these parts beyond a reasonable time.

SUMMARY OF THE INVENTION

The present invention overcomes the above described difficulties and disadvantages associated with prior art devices by providing spacers for cage presses which use substantially less material of readily available stock and which are easily formed to provide the necessary spacing and support between adjacent screen bars, without the necessity of producing large quantities well in advance of the time of their intended use.

The spacers of the present invention are positioned at uniformly spaced locations axially along the cylindrical cage formed by the radially spaced screen bars. Each spacer is formed of a single L-shaped piece of sheet material, the thickness of which is substantially the same as the desired minimum spacing between adjacent screen bars. Each of the spacers is positioned between adjacent screen bars so that a leg portion thereof extends substantially radially inward to a position adjacent innermost edge portions of the screen bars, and a foot portion of the spacer extends substantially tangentially between adjacent screen bars near their outer edge portions and in an engagement therewith, all of the spacers being secured to an associated screen bar by an adjacent leg portion. Each of the plurality of spacers are preferably welded to the adjacent screen bar at uniformly spaced locations along the length of the bar.

DETAILED DESCRIPTION OF THE PREFERRED EMBODIMENT

The spacer 10 of the present invention is formed from a single piece of sheet metal, made of such material as stainless steel sheet which is more resistant to the materials that would normally be processed through a cage press of the type to which the present invention pertains. The spacer 10 is formed into a L-shaped configuration as shown, with a short foot portion 12 extending substantially 90° to a leg portion 14. The lengths of the foot and leg portions 12 and 14 depend upon the configuration of the cage press and will vary with variations in press cage diameter, dimensions of the screen bars and the gap between adjacent screen bars, but these lengths can easily be calculated for any given condition.

Figure 1:
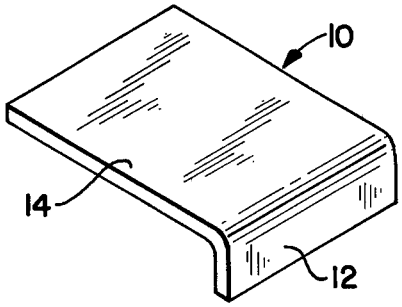
FIG. 1 is a pictorial view of the preferred embodiment of spacer of the present invention.
Figure 2:
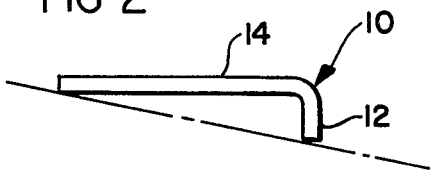
FIG. 2 is a side view of the embodiment of FIG. 1 with a line indicating the relative position of the spacer to the surface of a screen bar.
Figure 3:
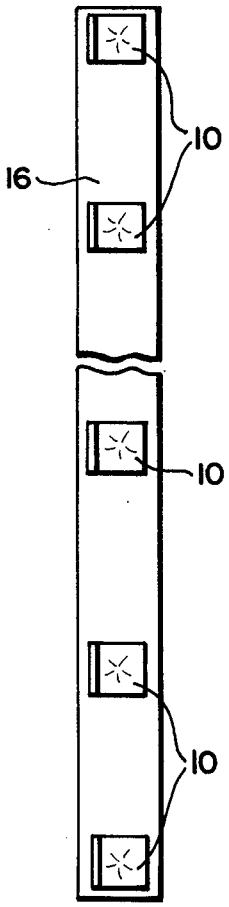
FIG. 3 is a plan view of a screen bar with a plurality of spacers of the preferred embodiment positioned uniformly along the length of the screen bar and welded thereto.
Figure 4:
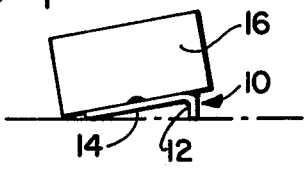
FIG. 4 is an end view of a screen bar with a spacer welded thereto.
Figure 5:
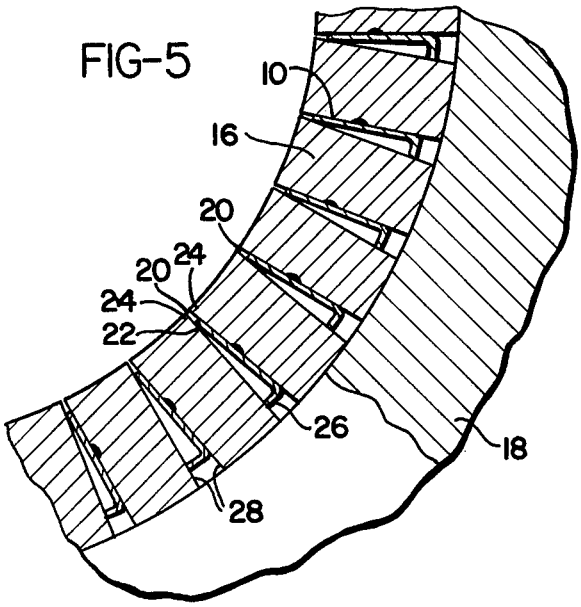
FIG. 5 is a cross sectional view through a portion of a cage press showing the screen bars and spacers in their operative positions.

A single screen bar 16 is illustrated in FIG. 3 with a plurality of spacers 10 welded thereto with each leg portion 14 in surface-to-surface contact therewith. Screen bars 16 are also often constructed of stainless steel to resist corrosion from the materials being processed in the press. The plurality of spacers 10 are positioned uniformly along the length of each screen bar 16, i.e. axially along the press when assembled, preferably at positions which correspond to the location of external cylindrical support ribs 18, as shown in FIG. 5, which are generally utilized in such presses to provide support for the screen bars and establish the cylindrical configuration of the press. By positioning the spacers at the same location as the external ribs, no additional space along the length of the screen bar assembly is blocked, as would be the case if the spacers were randomly positioned or positioned out of registry with the ribs.

Simply welding spacers 10 to the screen bars 16 makes the assembly process relatively simple and inexpensive compared to other methods of attachment used in the prior art. Preferably a spot welder is used with a jig attached to properly locate each spacer on the bar prior to welding.

Referring to FIG. 5, when assembled, the plurality of spacers 10 and screen bars 16 as supported by the cylindrical support ribs 18 form a cylindrical cage with a plurality of gaps or slots 20 extending axially of the press, through which the liquid expressed from the material being processed can pass. The width of these slots 20 is established by the thickness of the end portion 22 of each of the legs 14 of spacers 10, as well as the position of this end portion 22 relative to the innermost edge portions 24 of adjacent screen bars, since the gap is established by the contact of adjacent screen bars on the edge portion 22 of each spacer therebetween.

The length of the leg portions 12 is calculated to extend substantially tangentially so that their outermost ends 26 are in contact with the adjacent surface of a screen bar 16 to provide support therebetween, close to the outermost end portions 28 of the screen bars. This is to provide rigidity of the structure under the compressive loads which are experienced during operation of the press.

Again, however, the exact thickness of spacers 10, as well as the lengths of the leg portions 14 and foot portions 12, can be easily calculated for a given press and a desired separation at the innermost edge portions 24 of adjacent screen bars 16 in order to obtain the proper spacing when assembled.

As seen in FIG. 3, the spacers are not as wide as a screen bar and are essentially centered widthwise of the bar. As can be appreciated, this positioning results in the innermost edge portions of adjacent screen bars being slightly closer together than the thickness of the spacers, as can be seen in FIG. 5. Generally, this difference is so small as to be negligable, however, if desired, the difference can easily be taken into account by increasing the thickness of the spacer to establish the exact width of the slots 20.

While the form of apparatus herein described constitute a preferred embodiment of this invention, it is to be understood that the invention is not limited thereto, and that changes may be made therein without departing from the scope of the invention.

What is claimed is:

1. Spacers for use in a cylindrical cage of a continuous screw press having axially extending and radially spaced screen bars, said spacers being positioned between said radially spaced screen bars at uniformly spaced locations axially along said cylindrical cage, each said spacer being formed of a single L-shaped piece of sheet material the thickness of which is substantially the desired minimum spacing between adjacent said screen bars, each said spacer being positioned between adjacent screen bars so that a leg portion of said spacer extends substantially radially inward to a position adjacent innermost edge portions of said screen bars, and a foot portion of said spacer extends substantially tangentially between adjacent screen bars and in engagement therewith, all of said spacers being secured to an associated screen bar by an adjacent leg portion.

2. Spacers as defined in claim 1 wherein a plurality of said spacers are welded to an adjacent screen bar at uniformly spaced locations along its length.

3. In a continuous screw press having a cylindrical cage formed of axially extending and radially spaced screen bars, the improvement comprising:

a plurality of spacers disposed between adjacent screen bars at a plurality of positions uniformly spaced along the length of said screen bars, each said spacer being formed of a single piece of sheet material having a thickness substantially the same as the desired minimum distance between adjacent screen bars, and each being bent to form an L-shape with a leg portion extending radially inward of said cage in surface-to-surface contact with an adjacent screen bar and terminating adjacent innermost edge portions of said adjacent screen bars in contact with both said adjacent screen bars to establish said minimum distance therebetween, and a foot portion extending tangentially between said adjacent screen bars and in engagement therewith.

4. The improvement defined in claim 3 wherein all of said spacers are welded on said leg portions to an adjacent screen bar.

* * * * *